US008172655B2

(12) United States Patent
Liu

(10) Patent No.: US 8,172,655 B2
(45) Date of Patent: May 8, 2012

(54) AIR CONDITIONER

(75) Inventor: Ming-Yen Liu, Taipei (TW)

(73) Assignee: ASUSTeK Computer Inc., Peitou, Taipei (TW)

( * ) Notice: Subject to any disclaimer, the term of this patent is extended or adjusted under 35 U.S.C. 154(b) by 893 days.

(21) Appl. No.: 12/194,287

(22) Filed: Aug. 19, 2008

(65) Prior Publication Data

US 2009/0079642 A1 Mar. 26, 2009

(30) Foreign Application Priority Data

Sep. 20, 2007 (TW) ..... 96135073 A

(51) Int. Cl.
*F24F 7/00* (2006.01)

(52) U.S. Cl. ..... 454/256; 454/284; 343/720; 62/178

(58) Field of Classification Search ..... 343/718, 343/720, 757; 236/51; 454/224, 284, 256; 455/3.06, 344, 76, 90.3; 62/138, 178, 186, 62/262, 276; 700/276
See application file for complete search history.

(56) References Cited

U.S. PATENT DOCUMENTS

| | | | | |
|---|---|---|---|---|
| 2,596,479 | A * | 5/1952 | Goldstine | 343/720 |
| 3,611,376 | A * | 10/1971 | Gutleber | 342/144 |
| 5,390,206 | A * | 2/1995 | Rein et al. | 375/130 |
| 5,519,405 | A * | 5/1996 | Matsubara et al. | 342/359 |
| 5,614,908 | A * | 3/1997 | Phelan et al. | 342/33 |
| 5,839,654 | A * | 11/1998 | Weber | 236/47 |
| 5,994,984 | A * | 11/1999 | Stancil et al. | 333/248 |
| 6,208,296 | B1 * | 3/2001 | Saib | 342/422 |
| 6,364,211 | B1 * | 4/2002 | Saleh | 236/49.3 |
| 6,512,379 | B2 * | 1/2003 | Harrold et al. | 324/632 |
| 6,631,619 | B2 * | 10/2003 | Nonaka et al. | 62/126 |
| 6,689,994 | B2 * | 2/2004 | Reichelt | 219/634 |
| 6,816,121 | B1 * | 11/2004 | Cheng et al. | 343/702 |
| 7,129,891 | B2 * | 10/2006 | Meunier | 342/463 |
| 7,629,935 | B2 * | 12/2009 | Mansour et al. | 343/757 |
| 7,810,739 | B2 * | 10/2010 | Tazawa et al. | 236/91 C |
| 7,888,903 | B2 * | 2/2011 | Son et al. | 318/648 |
| 7,936,253 | B2 * | 5/2011 | Ishimoto et al. | 340/13.24 |
| 2004/0051668 | A1 * | 3/2004 | Chang | 343/702 |
| 2004/0176022 | A1 * | 9/2004 | Thrasher et al. | 454/256 |
| 2005/0285803 | A1 * | 12/2005 | Iacono et al. | 343/702 |
| 2006/0155421 | A1 | 7/2006 | Baek | |
| 2008/0041969 | A1 * | 2/2008 | Nathan | 236/49.3 |
| 2009/0138124 | A1 * | 5/2009 | Takach et al. | 700/276 |
| 2009/0262035 | A1 * | 10/2009 | Gonikberg | 343/757 |
| 2011/0053487 | A1 * | 3/2011 | Casey | 454/258 |

FOREIGN PATENT DOCUMENTS

| | | |
|---|---|---|
| CN | 2510772 | 9/2002 |
| CN | 3458914 | 7/2005 |
| JP | 10205862 | 8/1998 |
| TW | 343263 | 10/1998 |
| TW | 585243 | 4/2004 |

* cited by examiner

*Primary Examiner* — Steven B McAllister
*Assistant Examiner* — Jamil Decker
(74) *Attorney, Agent, or Firm* — Muncy, Geissler, Olds & Lowe, PLLC

(57) ABSTRACT

An air conditioner includes an air conditioning module and a wireless access module. The air conditioning module has at least one blade for controlling the wind direction of the air conditioning module. The wireless access module has at least one antenna. The antenna is disposed on the blade.

14 Claims, 4 Drawing Sheets

AIR CONDITIONER

CROSS REFERENCE TO RELATED APPLICATIONS

This Non-provisional application claims priority under 35 U.S.C. §119(a) on Patent Application No(s). 096135073 filed in Taiwan, Republic of China on Sep. 20, 2007, the entire contents of which are hereby incorporated by reference.

BACKGROUND OF THE INVENTION

1. Field of Invention

The invention relates to an air conditioner and, in particular, to an air conditioner with a wireless access function.

2. Related Art

According to the progressive of wireless transmission technology, the WLAN (wireless local area network) has been widely used. The user can access a WLAN through single or multiple WAPs (wireless access point) so as to connect to Internet. However, the conventional WAP still has some drawbacks to be improved so as to provide more convenient functions.

As shown in FIG. 1, a conventional WAP 1 includes a control body 11 and a plurality of antennas 12. The signals can be fed into the antennas 12 from the control body 11. Then, the antennas 12 radiate the electromagnetic waves to transmit the wireless signals. In addition, the antennas 12 can receive the wireless signals, which are in the forms of electromagnetic waves, and then transmit the wireless signals back to the control body 11 for signal processing.

The antenna 12 can achieve the optimum transmission performance if it is not blocked. However, regarding to the room space in the building, the WAP 1 is usually not disposed at the highest place but positioned on the table or any place that the WAP 1 can be easily installed. This is for simplifying the installation and preventing the WAP 1 from affecting the room decoration. However; the WAP 1, which is positioned on the table, is usually interfered by other furniture or equipments, so that the transmission performance of the electromagnetic waves of the WAP 1 is decreased.

Therefore, it is an important subject to provide an apparatus having the wireless access function so as to reduce the space for installing the WAP and enhance the transmission performance of the antenna.

SUMMARY OF THE INVENTION

An object of the invention is to provide an air conditioner with an antenna, which can be used as a wireless access point (WAP) and enhance the transmission performance of the antenna.

To achieve the above object, the invention discloses an air conditioner including an air conditioning module and a wireless access module. The air conditioning module has at least one blade for controlling a wind direction of the air conditioning module. The wireless access module has at least one antenna disposed on the blade.

As mentioned above, the air conditioner of the invention has the wireless access module and air conditioning module, and the antenna of the wireless access module is disposed on the blade for controlling a wind direction of the air conditioning module. Compared with the prior art, the air conditioner of the invention has the wireless access function due to the wireless access module. According to the invention, the space for installing the conventional WAP is not needed.

Recently, every family usually has at least one air conditioner, such as a cooler, a heater, a dehumidifier, an air cleaner, a cool fan or a fan. If the air conditioner has the wireless access function, the space for installing the conventional WAP is not needed. In addition, since the air conditioner is usually disposed at a higher place or an open place, the antenna disposed in the air conditioner will not be blocked, thereby enhancing the transmission performance of the electromagnetic waves.

BRIEF DESCRIPTION OF THE DRAWINGS

The invention will become more fully understood from the detailed description and accompanying drawings, which are given for illustration only, and thus are not limitative of the present invention, and wherein.

DETAILED DESCRIPTION OF THE INVENTION

The present invention will be apparent from the following detailed description, which proceeds with reference to the accompanying drawings, wherein the same references relate to the same elements.

Figure 1:
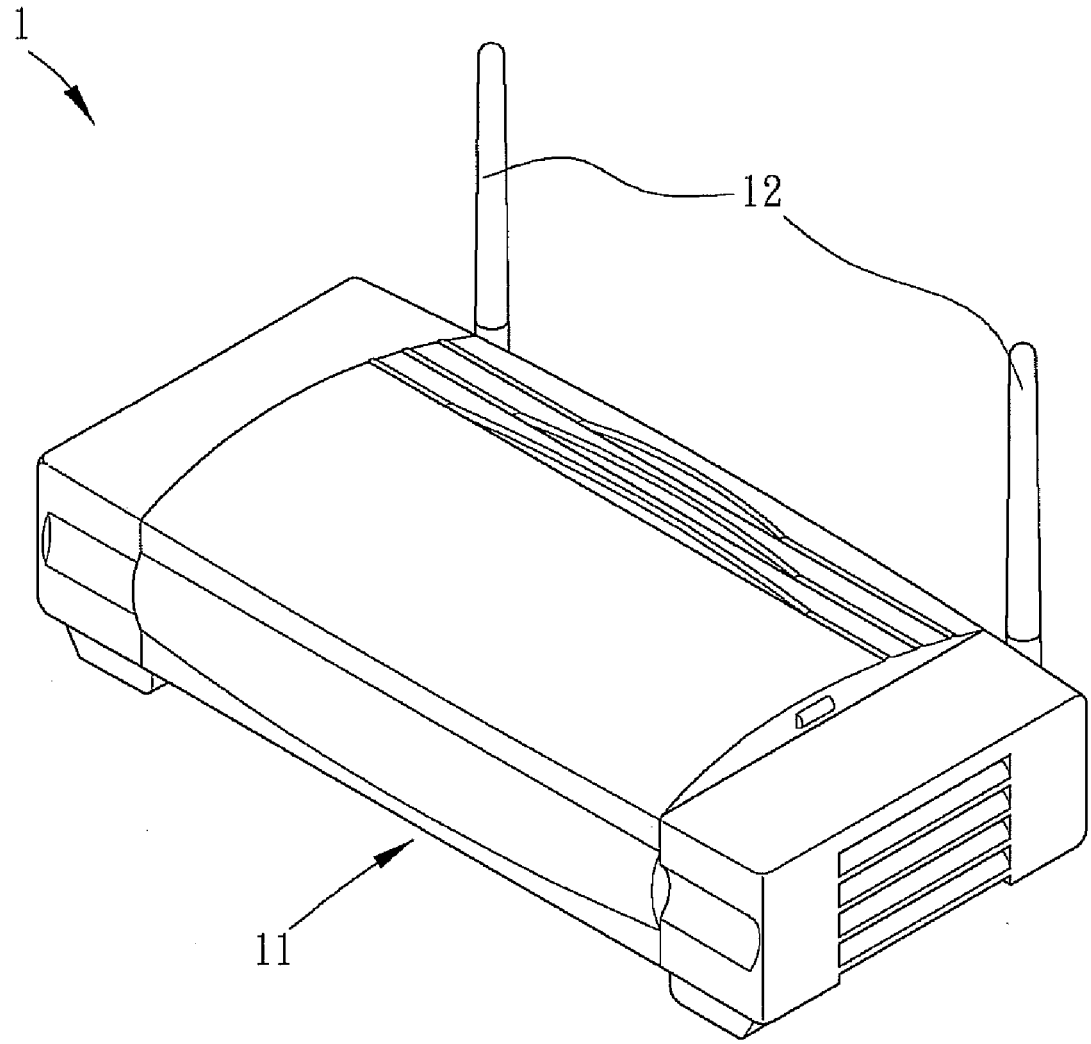
FIG. 1(Prior Art)
FIG. 1 is a schematic diagram of a conventional wireless access point.
Figure 2:
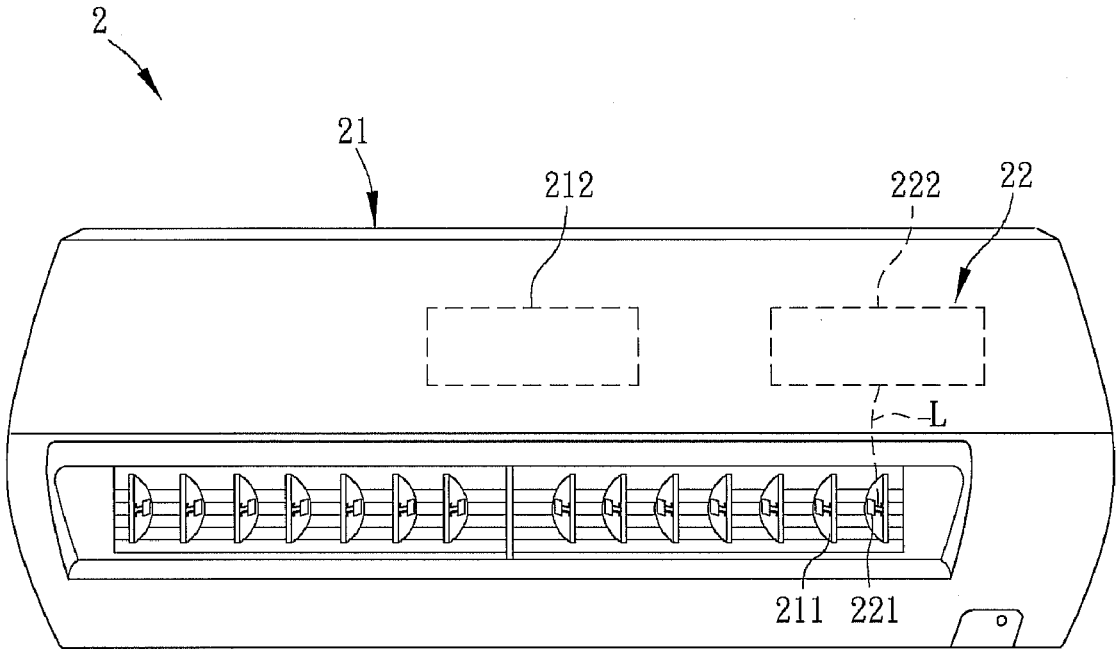
FIG. 2 is a schematic diagram of an air conditioner according to a preferred embodiment of the invention.

With reference to FIG. 2, an air conditioner 2 according to the preferred embodiment of the invention includes an air conditioning module 21 and a wireless access module 22. The air conditioner 2 can be a cooler; a heater, a dehumidifier; an air cleaner, a cool fan or a fan. Correspondingly, the air conditioning module 21 can be a cooling apparatus, a heating apparatus, a dehumidifying apparatus, an air cleaning apparatus, a cool fan apparatus or a fan apparatus. In the embodiment, the air conditioner 2 is a cooler.

The air conditioning module 21 has a first control unit 212 and at least one blade 211 for controlling the wind direction of the air conditioning module 21. The blade 211 is disposed at an outlet side of the air conditioning module 21. The first control unit 212 can control the blade 211 to rotate, so that the cold air outputted by the cooling apparatus of the air conditioning module 21 can be guided toward the desired direction by the blade 211. In the embodiment, the air conditioning module 21 has a plurality of the blades 211, and the blades 211 can be arranged toward the same direction or different directions.

For example, the wireless access module 22 can be a wireless access point (WAP), but it's not limited. The wireless access module 22 includes at least one antenna 221 and a second control unit 222.

The second control unit 222 and the antenna 221 are electrically connected with each other. The second control unit 222 can feed the signal into the antenna 221 through the coaxial transmission line L, and then the antenna 221 can transmit the signal in the form of electromagnetic wave. In addition, the antenna 221 can transmit the signal in the form of electromagnetic wave to the second control unit 222 through the coaxial transmission line L so as to detect an intensity of the signal received by the antenna 221. The second control unit 222 can be disposed inside or outside the air conditioning module 21. Preferably, the second control unit 222 is disposed inside the air conditioning module 21 for reducing the occupied space. In the embodiment, the first control unit 212 and the second control unit 222 can be disposed separately or integrally on a circuit board.

The antenna 221 is disposed on the blade 211. In the embodiment, the wireless access module 22 has a plurality of antennas 221, which are disposed on the blades 211, respectively. The blade 211 can be the carrier or the substrate of the antenna 221. The antenna 221 and the blade 211 can be connected by adhering, locking, screwing or wedging, but it's not limited. Alternatively, the antenna 221 and the blade 211 can be integrally formed by etching or double injection molding. In the etching method, a metal layer is formed on the blade 211 in advance, and the metal layer is etched to form the desired pattern, which constructs the antenna 221. In the double injection molding method, the antenna 221 is manufactured in advance. Then, the antenna 221 is disposed in a mold, and a non-metal plastic material is injected into the mold. Thus, the blade 211 and the antenna 221 can be formed by double injection molding, so that the blade 211 can be tightly connected to the periphery of the antenna 221.

Figure 3A:
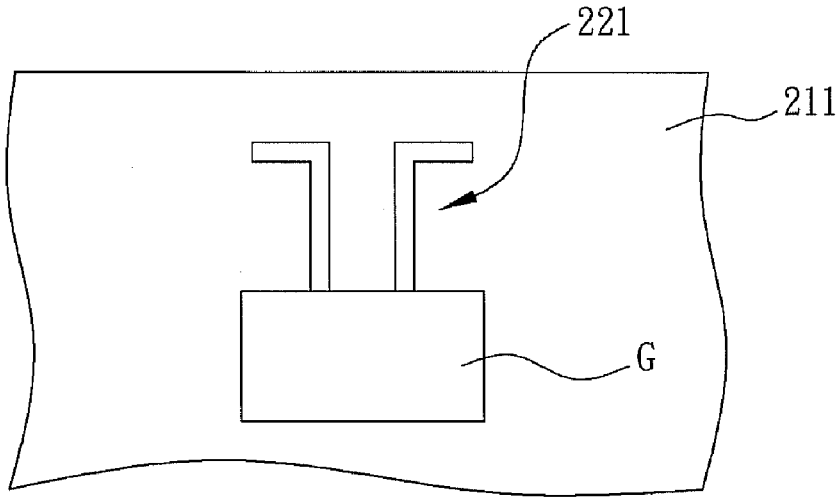
FIGS. 3A to 3C are schematic diagrams showing different combination aspects of the blade and antenna in the air conditioner according to the preferred embodiment of the invention.

The combination aspects of the antenna 221 and the blade 211 will be described hereinbelow with reference to FIGS. 3A to 3C. FIG. 3A is a top view of the combination of the antenna 221 and the blade 211. In this case, the antenna 221 is a dipole antenna and has a grounding area G. Of course, the antenna 221 can be a monopole, a planar or a planar inverted-F antenna. In addition, the antenna 221 can be a single-band or a dual-band antenna. The type of antenna 221 is not limited to the above description, and it can be configured depending on the product need. Alternatively, the antenna 221 can be an omni-directional or a directional antenna. In the embodiment, the antenna 221 is preferably a directional antenna.

Figure 3B:
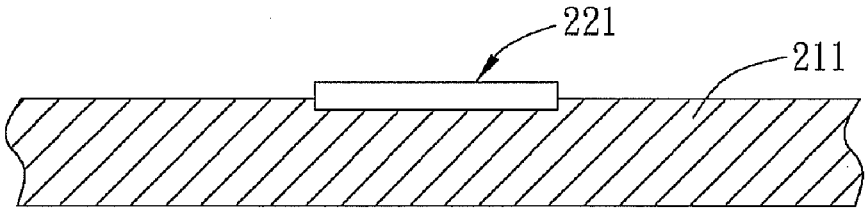
Figure 3C:
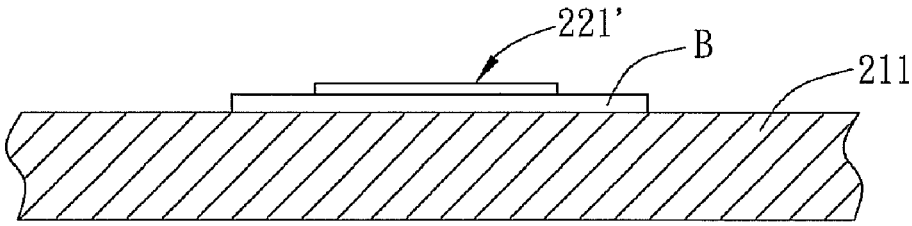

As shown in FIG. 3B, the antenna 221 is embedded in the blade 211. The blade 211 can be an insulation substrate, such as a ceramic substrate or a resin substrate. As shown in FIG. 3C, the antenna 221' has a substrate B, such as a ceramic substrate or a resin substrate, and the substrate B is disposed on the blade 211. In this case, the blade 211 is a carrier for carrying the antenna 221'.

Figure 4:
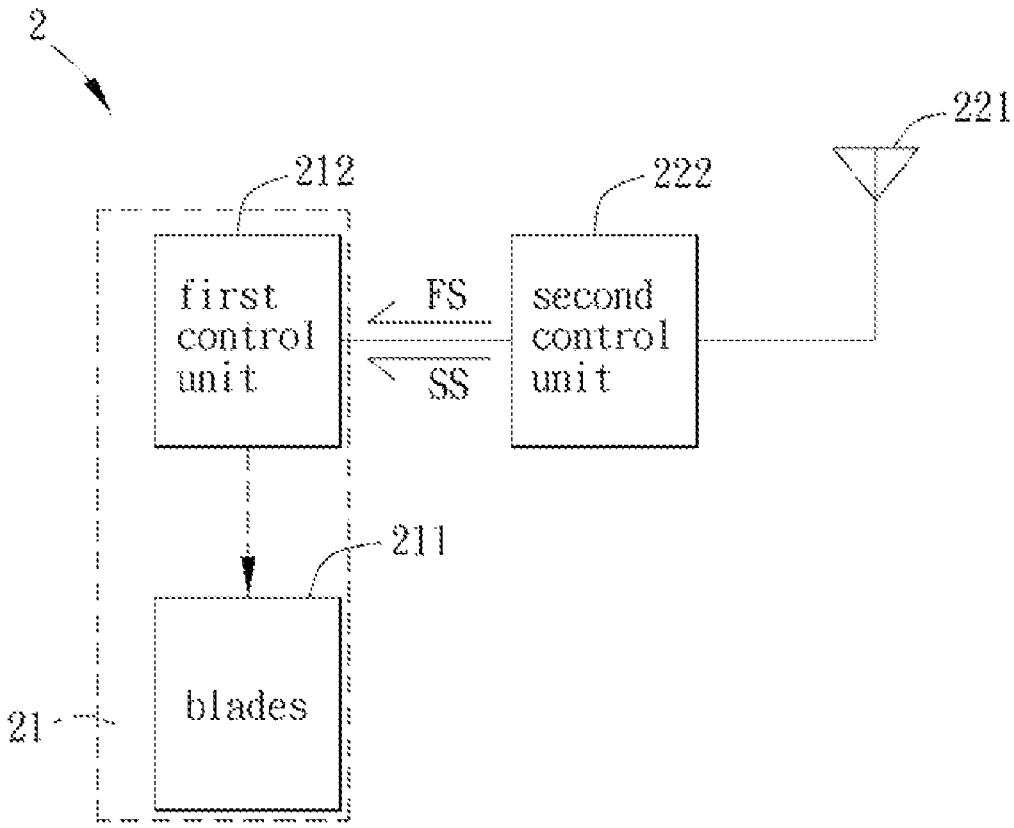
FIG. 4 is a block diagram showing the air conditioner according to the preferred embodiment of the invention.

The function of the air conditioner 2 will be described hereinbelow with reference to FIG. 4. The first control unit 212 and the second control unit 222 are electrically connected with each other. When the blades 211 rotate, the second control unit 222 can detect the intensities of the signals received by the antenna 221 as the blades 211 rotate to different directions. For example, when the blades 211 rotate to a first direction, the second control unit 222 can detect the strongest intensity of the signal. Then, the second control unit 222 transmits a first control signal FS to the first control unit 212. The first control unit 212 controls at least one part of the blades 211 toward the first direction according to the first control signal FS. Accordingly, some directional antennas 221 can face the source of the electromagnetic wave so as to enhance the transmission performance. In addition, the blades 211 can be rotated toward the position of the user, so that the airflow outputted from the air conditioning module 21 can be guided toward the user, thereby increasing the performance of the air conditioner 2.

In addition, the second control unit 222 can detect the intensity of signal in the space to find a secondary intensity at a second direction. Then, the second control unit 222 transmits a second control signal SS to the first control unit 212, and the first control unit 212 can control the other part of the blades 211 toward the second direction according to the second control signal SS. Accordingly, some of the directional antennas 221 can face the source of electromagnetic wave with the secondary intensity so as to further enhance the transmission performance. In addition, some of the blades 211 can be rotated toward the position of the user, so that the airflow outputted from the air conditioning module 21 can be guided toward the user, thereby increasing the performance of the air conditioner 2.

To sum up, the air conditioner of the invention has the antenna disposed on the blade for controlling a wind direction of the air conditioning module. Compared with the prior art, the air conditioner of the invention has the wireless access function due to the wireless access module. In addition, according to the invention, the space for installing the conventional WAP is not needed. Moreover, the air conditioner is usually installed at higher place, which can facilitate the transmission of electromagnetic waves for the antenna.

Although the invention has been described with reference to specific embodiments, this description is not meant to be construed in a limiting sense. Various modifications of the disclosed embodiments, as well as alternative embodiments, will be apparent to persons skilled in the art. It is, therefore, contemplated that the appended claims will cover all modifications that fall within the true scope of the invention.

What is claimed is:

1. An air conditioner comprising:

An air conditioning module having at least one blade and a first control unit for controlling the at least one blade, wherein the blade controls a wind direction of the air conditioning module; and a wireless access module, to allow a user to wirelessly access a wireless local area network via the wireless access module, having at least one antenna and a second control unit, wherein the antenna is disposed on the at least one blade, and the second control unit detects an intensity of a signal received by the antenna, wherein the first control unit is capable of directing the at least one blade to maximize the intensity of the signal.

2. The air conditioner according to claim 1, wherein the air conditioning module comprises a cooling apparatus, a heating apparatus, a dehumidifying apparatus, an air cleaning apparatus, a cool fan apparatus or a fan apparatus.

3. The air conditioner according to claim 1, wherein the blade is disposed at an outlet side of the air conditioning module.

4. The air conditioner according to claim 1, wherein the wireless access module is a wireless access point.

5. The air conditioner according to claim 1, wherein the antenna is a directional antenna.

6. The air conditioner according to claim 1, wherein the antenna is a monopole antenna, a dipole antenna, a planar antenna or a planar inverted-F antenna.

7. The air conditioner according to claim 1, wherein the antenna is connected with the blade by adhering, locking, screwing or wedging.

8. The air conditioner according to claim 1, wherein the antenna and the blade are integrally formed.

9. The air conditioner according to claim 1, wherein the antenna has a substrate disposed on the blade.

10. The air conditioner according to claim 1, wherein the first control unit controls the blade to rotate.

11. The air conditioner according to claim 10, wherein the second control unit is electrically connected with the first control unit, and the second control unit is further electrically connected with the antenna.

12. The air conditioner according to claim 11, wherein the second control unit is disposed inside or outside the air conditioning module.

13. The air conditioner according to claim 11, wherein when the air conditioning module comprises a plurality of blades, the second control unit transmits a control signal to the first control unit so as to control at least a part of the blades to rotate toward a first direction.

14. The air conditioner according to claim 13, wherein when the blades are positioned toward the first direction, the intensity of the signal detected by the second control unit is the strongest.

* * * * *